US009099287B2

(12) United States Patent
Giannakopulos

(10) Patent No.: US 9,099,287 B2
(45) Date of Patent: Aug. 4, 2015

(54) METHOD OF MULTI-REFLECTING TIMEOF FLIGHT MASS SPECTROMETRY WITH SPECTRAL PEAKS ARRANGED IN ORDER OF ION EJECTION FROM THE MASS SPECTROMETER

(75) Inventor: Anastassios Giannakopulos, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/128,189

(22) PCT Filed: Jun. 19, 2012

(86) PCT No.: PCT/EP2012/061750

§ 371 (c)(1),
(2), (4) Date: Dec. 20, 2013

(87) PCT Pub. No.: WO2013/004493

PCT Pub. Date: Jan. 10, 2013

(65) Prior Publication Data

US 2014/0117226 A1 May 1, 2014

(30) Foreign Application Priority Data

Jul. 4, 2011 (GB) ..... 1111357.8

(51) Int. Cl.
*H01J 49/00* (2006.01)
*H01J 49/40* (2006.01)
*H01J 49/16* (2006.01)

(52) U.S. Cl.
CPC ..... *H01J 49/0031* (2013.01); *H01J 49/164* (2013.01); *H01J 49/406* (2013.01); *H01J 49/408* (2013.01)

(58) Field of Classification Search
CPC ... H01J 49/00; H01J 49/0027; H01J 49/0031; H01J 49/0036; H01J 49/004; H01J 49/0086; H01J 49/034; H01J 49/40; H01J 49/405; H01J 49/406
USPC ..... 250/281, 282, 283, 287, 290
See application file for complete search history.

(56) References Cited

U.S. PATENT DOCUMENTS 6,160,256 A * 12/2000 Ishihara ..... 250/287
6,300,626 B1 10/2001 Brock et al.

(Continued)

FOREIGN PATENT DOCUMENTS

GB 2080021 A * 1/1982
WO 2008071921 A2 6/2008

(Continued)

OTHER PUBLICATIONS

Casares et al., "Multipass time-of-flight mass spectrometers with high resolving powers," Int'l Journal of Mass Spectrometry, 206(3):267-273, 2001.

(Continued)

*Primary Examiner* — Nicole Ippolito
*Assistant Examiner* — Jason McCormack
(74) *Attorney, Agent, or Firm* — Charles B. Katz

(57) ABSTRACT

A multi reflection time of flight (MRTOF) mass spectrometer (12) And method for identifying a sample is disclosed. Sample ions are generated at an ion source (15). The MRTOF is a closed mirror arrangement with first and second opposed ion mirrors (20, 20') on an axis of reflection (XX'). The MRTOF (12) also includes a bidirectional ion deflector (50) on that axis (XX'). The deflector (50) deflects ions onto the reflection axis as a short pulse at time to <zero> where they oscillate multiple times, separating in time of flight according to ion m/z. At a later time t, ions travelling in both directions along the axis (XX') are ejected out of the MRTOF (12) by the bidirectional deflector (50) to an ion detector arrangement (55). The separation of ions in time of flight allows a "fingerprint" of a biological sample to be produced by the detector arrangement (55) without the need to assign a mass to each peak. Comparison with a library of fingerprints permits identification.

28 Claims, 8 Drawing Sheets

(56) References Cited

U.S. PATENT DOCUMENTS

| | | | | |
|---|---|---|---|---|
| 7,265,346 | B2 * | 9/2007 | Whitehouse et al. | 250/287 |
| 2002/0059151 | A1 * | 5/2002 | Soufian et al. | 706/15 |
| 2005/0253061 | A1 * | 11/2005 | Cameron et al. | 250/287 |
| 2007/0176090 | A1 * | 8/2007 | Verentchikov | 250/287 |
| 2007/0200060 | A1 * | 8/2007 | Russ et al. | 250/288 |
| 2008/0121796 | A1 * | 5/2008 | Green et al. | 250/283 |
| 2008/0197276 | A1 * | 8/2008 | Nishiguchi et al. | 250/287 |
| 2010/0072363 | A1 * | 3/2010 | Giles et al. | 250/287 |
| 2011/0180705 | A1 * | 7/2011 | Yamaguchi | 250/287 |
| 2011/0240845 | A1 * | 10/2011 | Ding | 250/282 |

FOREIGN PATENT DOCUMENTS

| | | | |
|---|---|---|---|
| WO | WO 2009081143 | A2 * | 7/2009 |
| WO | 2010008386 | A1 | 1/2010 |

OTHER PUBLICATIONS

Lei et al., "Mass Spectrometry Strategies in Metabolomics," Journal of Biological Chemistry, 286(29):25435-25442, 2011.

* cited by examiner

METHOD OF MULTI-REFLECTING TIMEOF FLIGHT MASS SPECTROMETRY WITH SPECTRAL PEAKS ARRANGED IN ORDER OF ION EJECTION FROM THE MASS SPECTROMETER

FIELD OF THE INVENTION

This invention relates to a method of identification of samples of unknown composition or type, particularly, but not exclusively, microbes such as bacterial or fungal colonies. It also relates to an apparatus for identification of samples such as microbiological organisms.

BACKGROUND OF THE INVENTION

Various different techniques for the analysis and identification of microbiological organisms such as bacterial or fungal colonies have been developed. For example, the technique of culture collection has been established for many years. Here, a sample of material to be identified/analysed is collected and this sample is then incubated to grow a culture which can then be analysed microscopically, for example. This technique is slow (it takes at least some hours and may take days) and can miss many types of bacteria.

A second technique for microbiological analysis is so-called polymerase chain reaction (PCR). This procedure amplifies a specific region of a DNA strand. PCR diagnosis in microbiology is based upon the detection of infectious agents and the discrimination of non-pathogenic from pathogenic strains by virtue of the identification of specific genes.

A further technique for microbiological analysis and identification employs a time of flight (TOF) mass spectrometer with a matrix assisted laser desorption ionization (MALDI) source. The MALDI technique was developed in the late 1980s and its application to the analysis of biological macro molecules by Tanaka at Shimadzu Corporation was awarded the Nobel Prize for Chemistry in 2002. An early description of the principles may be found in Rapid Communications in Mass Spectrometry, 1988, Volume 2, page 151, by K. Tanaka et al. Using this technique, reproducible, species-specific spectral patterns can be generated, and used to identify micro-organisms at the species level.

A broad spectrum of organisms have been identified using the MALDI TOF technique, including gram-positive and gram-negative bacteria, nocardia, mycobacteria, yeasts and moulds. The technique is relatively rapid (certainly compared to culture collection techniques), has minimal consumable costs, and provides an accuracy comparable to genome sequencing. A further discussion of the MALDI TOF technique may be found in Seng, P., M. Drancourt, F. Gouriet, B. La Scola, P. E. Fournier, J. M. Rolain, and D. Raoult, "Ongoing Revolution in Bacteriology: Routine Identification of Bacteria by Matrix-Assisted Laser Desorption Ionization Time of Flight Mass Spectrometry" Clin. Infect. Dis. 2009, August 15; 49(4): pages 552-3; see also http://www.ncbi.nlm.nih.gov/pubmed/19583519.

Mass spectra obtained by three different research institutes, using the MALDI TOF mass spectrometry technique, for the same bacterium (in this case, *E. coli* (atcc 33694)), are shown in an article by Wunschel et al. in the Journal of the American Society for Mass Spectrometry, Volume 16, Issue 4, April 2005, Pages 456-462 (http://www.sciencedirect.com/science/article/pii/S1044030504008220). Each of the mass spectra shown in the Wunschel et al paper represent a 50 shot average spectrum. The Wunschel et al paper also shows generated biological fingerprints from the mass spectra of the three mass spectra obtained by the three different research institutes. These fingerprints simplify the mass spectra by, for example, removing the baseline noise. In the fingerprints of the Wunschel paper, the horizontal (x) axis represents mass to charge ratio (m/z) whilst the vertical (y) axis represents relative intensity of the peaks.

Whilst it may be seen in the Wunschel et al paper that there are clearly peaks in common between the three fingerprints (in particular, the large peak around m/z=7,000 and some smaller peaks that appear to correspond around m/z=9,500) equally there are many peaks that appear only in one or other of the three fingerprints. Since the fingerprints themselves have been generated from nominally identical microbiological materials, the accuracy of identification (by comparison of the fingerprints with a library of such fingerprints) is directly related to the degree to which the measured fingerprint corresponds with the fingerprint in the database of the microbe under analysis.

Part of the reason for the discrepancy between the three fingerprints in the Wunschel et al paper is that the MALDI TOF mass spectrometry technique currently employed generates low to very low resolution fingerprints, albeit at good sensitivity and relatively low cost. In bacterial identification, upwards of 200 peaks of bacterial origin are detected, but perhaps only a quarter of these relate to (that is, are specific to) a particular species and can thus serve to identify or differentiate that species from others.

In addition to the relatively low resolution (resolution being a measure of the ability to discriminate between adjacent peaks), current databases also contain fingerprints with m/z only up to around 10,000. However, as may be seen in the fingerprint generated from the National Institute of Standards and Technology in the Wunschel et al paper, it would be desirable to extend the mass range up to 20,000. Moreover, a higher resolution and higher sensitivity would allow for a more specific identification.

The current MALDI TOF for bacteria identification mainly uses linear TOF mass spectrometers. High resolution instruments do exist. For example, devices such as multi-reflection TOFs with ion mirrors are known as such. However, they are expensive and large and are inherently less sensitive than existing linear TOF mass spectrometers employed for biological identification. The FTMS instruments such as the Orbitrap™ and FT-ICR MS instruments can provide very high sensitivity but have limitations on their mass range and are not suited to the larger singly charged species typically produced by a MALDI ion source.

SUMMARY OF THE INVENTION

Against this background, it is an object of the present invention to address the problems in the art.

According to a first aspect of the present invention, there is provided a method of identifying a sample comprising:

(a) generating sample ions from the sample to be identified;

(b) introducing at a time to the sample ions into a sample multi-pass time of flight (TOF) mass spectrometer and causing at least some of the ions to travel repeatedly along a path in the TOF mass spectrometer where ions of different m/z separate in time of flight and further wherein ions of at least a first m/z overtake ions of at least a second, different m/z;

(c) ejecting the sample ions from the TOF starting at a time $t_1$ ($>t_0$);

(d) detecting the ejected ions; and (e) generating a first fingerprint of the sample which comprises a plurality of peaks, each peak arising from ions of a particular mass to charge ratio and being arranged in sequential relation to their order of ejection from the multi-pass TOF at or following $t_1$ but wherein at least some of the peaks are not arranged in sequential order of m/z, the first fingerprint being comparable with a library of fingerprints of known samples, for identification of the sample to be identified.

The invention is particularly useful where the sample to be identified is a microorganism, examples of which include bacteria or fungi. Accordingly, in such cases, the fingerprint is a biological fingerprint and the library or database is one of fingerprints of known microorganisms. However, the invention may also be applied to the identification of other biological samples than microorganisms, as well as to non-biological samples. In the following description, particular reference will be made to the case of a microorganism but it is to be understood that this is for illustration and is but an example of a generic sample.

The inventor has recognised that a mass spectrum is not necessary for the production of a fingerprint that may be used to identify a microorganism. In particular, it has been realised that it is unnecessary to obtain a formal mass spectrum with the constituent molecules ordered by ascending or descending m/z. All that is necessary is the production of a signature wherein the constituent peaks are well separated, and are in an order which corresponds with, or at least can be mapped to, the order of peaks in a reference spectrum. In a simplest embodiment, this means that the peaks in the generated first biological fingerprint of the sample microorganism are in the same order as the peaks in a reference biological fingerprint in a sample library, for example, generated from the same microbiological material. As an alternative, however, the peaks in one or other of the sample and reference fingerprints may be generated in a different order with software manipulation of one or the other or both to map the peak locations in one of the sample and reference fingerprints to the same location as the same peak in the other of the sample and reference fingerprints.

Provided that the spectrometric parameters of the device(s) used to obtain the reference and sample fingerprints are the same, then, where the sample and reference microbiological materials correspond, the peaks due to the same ions should appear in the same relative locations in each fingerprint, when ions are ejected from the multi-pass TOF starting at the same time $t_1$, even when that peak order has no direct relationship with increasing or decreasing mass to charge ratio. Where the spectrometric parameters are different, however, a conversion factor or convolution must be applied to one or both of the sample and reference fingerprints, so that the peaks due to the same ions appear in the same relative locations in each fingerprint. For example, in the case of using a multi-reflection (MR) TOF as the multi-pass TOF, if the mirrors in the MR TOF used to obtain a reference biological fingerprint are separated by a different distance to the ion mirrors in the MR TOF used to analyse the sample and obtain the sample biological fingerprint, then the residence time in one or other of the MR TOFs needs to be adjusted. This is because, due to the different separation of the ion mirrors, ions of a given mass to charge ratio will be at a completely different place, and potentially travelling in a different direction, in each MR TOF at the same time after injection into each. Preferably, each of the sample and reference fingerprints are obtained with substantially the same peak resolution.

Although the increased mass range and sensitivity of the method set out here provides for a better confidence in matching sample fingerprints to reference fingerprints in a library or database, a still better confidence can be achieved by repeating the method with a different ion residence time in the TOF. By doing this, ions are ejected in a different order and peaks which might overlap when obtained from the first ion residence time might be disambiguated. Of course, a second reference fingerprint database (for this second residence time) may be desirable or necessary. In a preferred embodiment the generated fingerprint contains both a quantitative indication of ion abundance for each peak and also a quantitative indication of peak separation (that is, peaks are separated along the "x" axis of the fingerprint in relation to for example the ion ejection time from the trap). Such information optimises the information available to a comparison algorithm in attempting to match a sample fingerprint to a library of known (reference) fingerprints. Nevertheless it is to be understood that the invention in its broadest sense is not so limited; for example it is feasible to use only time separation (eg, to strip out any abundance information so that all peaks are of the same height) and still to obtain a fingerprint sufficient for obtaining a match to a reference database.

As a further preferred option, one or more lock mass ions (of known m/z and hence predictable ejection time from the multi pass TOF) may be introduced into the multi pass TOF along with (or subsequent to) the sample ions. The detection of the lock mass ion(s) can be used to adjust the position of the sample ions in the fingerprint or indeed to infer the positions of the sample ions without directly measuring them.

The term "multi-pass TOF" employed herein refers to a TOF mass spectrometer which has a closed path for the ions which have been introduced, such that at least some, preferably all, of the ions follow the closed path repeatedly (i.e. multiple times). Lighter ions will travel faster than heavier ions and will therefore travel along the closed path more times than the heavier ions. At some time after being introduced, some of the lighter ions will have traveled the closed path at least one more time than the heavier ions and will therefore overtake such heavier ions. Examples of such multi-pass TOFs with a closed path include a multi reflection (MR) TOF having a pair of ion mirrors which oppose each other such that ions are reflected repeatedly between the ion mirrors or a multi-turn TOF mass spectrometer (MULTUM) having a number of electrostatic sectors to maintain the ions travelling on a closed path for a number of cycles or orbits.

In the method of the present invention, at least some of the ions travel multiple times along the path in the multi-pass TOF mass spectrometer where ions of different m/z separate in time of flight and some of the ions overtake other ions. That is, in overtaking other ions some of the ions travel along the path at least one more time than the other ions. Typically, some ions overtake other ions after a few reflections or passes. This offers higher resolution of peak separation compared to an open path or linear TOF as the effective separation length in the case of a multi-pass TOF can be much longer. Mass resolution up to 100,000 may be obtained, for example where high source acceleration and post acceleration are employed. The TOF arrangements of the present invention also provide for high sensitivity compared to an open MR-TOF system using large TOF ion mirrors.

The ion source is a typical source for generating ions for introduction to a TOF mass spectrometer, preferably a MALDI source in the case of microorganisms. However, an electrospray (ESI) or other ion source could be used, depending on the sample type.

In accordance with a second aspect of the present invention, there is provided a multi reflection time of flight (MR TOF) mass spectrometer for identifying a sample comprising:

an ion source for generating sample ions;

a closed mirror MR TOF arrangement having first and second ion mirrors located so as to oppose each other along an axis of reflection;

a bi-directional ion deflector arrangement positioned along the axis of reflection and configured;

(i) to deflect sample ions introduced into the closed mirror MR TOF arrangement from the ion source and travelling along the axis of reflection in a first direction from the first to the second ion mirror to an ion detector arrangement, starting at a time $t_1$ after introduction into the closed mirror MR TOF arrangement; and (ii) to deflect sample ions introduced into the closed mirror MR TOF arrangement from the ion source and travelling along the axis of reflection in a second direction from the second to the first ion mirror to the ion detector arrangement also starting at the said time $t_1$.

By employing a bi-directional ion deflector, the whole contents of the closed mirror MR TOF can be deflected off the reflection axis and out of the mirror arrangement. This in turn allows the generation of data at both a high resolution (which is an inherent feature of the closed mirror MR TOF) but also allows a much wider mass range than previously to be obtained, which in turn increases the number of data points in the fingerprint, resulting in more data for deciding whether a sample microorganism matches microorganisms in a reference database.

Preferably, the ion detector arrangement comprises or includes a conversion dynode or post accelerating dynode, an electron multiplier and/or a digitiser and computer for storing the obtained data. In particularly preferred embodiments, ions travelling in a first direction between the first and second ion mirrors are deflected out of, but still generally travelling in, that first direction to a first ion detector, whilst ions travelling in the opposite direction in the ion mirror between the second and first ion mirrors are deflected out, again still travelling generally in the same direction to a second detector.

Thus the preferred arrangement does not require a detection system with a sub-nano second response, since the ion packets do not need to be smaller than 3-5 ns.

In accordance with still a further aspect of the present invention, there is provided a method of generating a reference fingerprint for a database of reference fingerprints representing a plurality of different reference samples, comprising:

(a) generating reference ions from the reference sample (b) introducing at a time $t_0$ the reference ions into a reference multi-pass TOF mass spectrometer and causing at least some of the ions to travel repeatedly along a path in the TOF mass spectrometer where ions of different m/z separate in time of flight and further wherein ions of at least a first m/z overtake ions of at least a second, different m/z;

(c) ejecting the reference ions from the reference multi passTOF starting at a time $t_1$ ($>t_0$);

(d) detecting the ejected ions; and (e) generating the reference fingerprint of the reference sample, wherein each peak of the reference fingerprint arises from ions of a particular mass to charge ratio and is arranged in sequential relation to their order of ejection from the multi-pass TOF at or following $t_1$ but wherein at least some of the peaks are not arranged in sequential order of m/z, the reference fingerprint being comparable with a fingerprint from a sample to be identified to determine whether the fingerprint from the sample is a match to the generated reference fingerprint.

The library may, of course, be constituted (populated) using the same type of TOF as is or will be used for subsequent sample analysis. On the other hand, the database or library of reference fingerprints might be created using a different TOF (perhaps with different spectral parameters as explained above), potentially in a different country.

It will also be understood that comparison of the sample fingerprint obtained (or, indeed, even the data processing of the raw data obtained from the sample TOF) can be carried out locally to that sample TOF or remotely at a different computer or indeed by accessing a library in another country.

Thus there is provided a high resolution bacterial MALDI identification method-apparatus which employs a small size inexpensive mass spectrometer. The resolution may approach that of FTMS but requires a residence time within the instrument of only a few milliseconds. Due to the very long flight path that is provided, the initial beam parameters for high resolution MALDI-TOF (with nanosecond or even sub nanosecond pulse widths) are very forgiving when compared to high resolution normal TOF. Hence, narrow pulse detection systems are not required.

There is also no requirement for c-trap and rf switching as is the case for FTMS. The invention may be implemented in a simple manner using a stable high voltage power supply (HV PSU) (two positive and two negative) and a low voltage (hundreds of volts) fast pulser for supply of a voltage to the mirror system and the ejection of ions. Whilst the HV PSU could in principle be a single HV PSU, in practice one or two high voltage power supplies and a pulser are desirable in order to implement the delayed extraction which is beneficial in reducing collisions with neutral MATRIX molecules and in minimising post source decay (PSD). Various other important and/or preferred aspects of the invention will become apparent from the following specific description and from a review of the appended claims.

BRIEF DESCRIPTION OF THE DRAWINGS

The invention may be put into practice in a number of ways some of which will now be described by way of example only and with reference to the accompanying drawings in which.

DETAILED DESCRIPTION OF PREFERRED EMBODIMENTS

Figure 1:
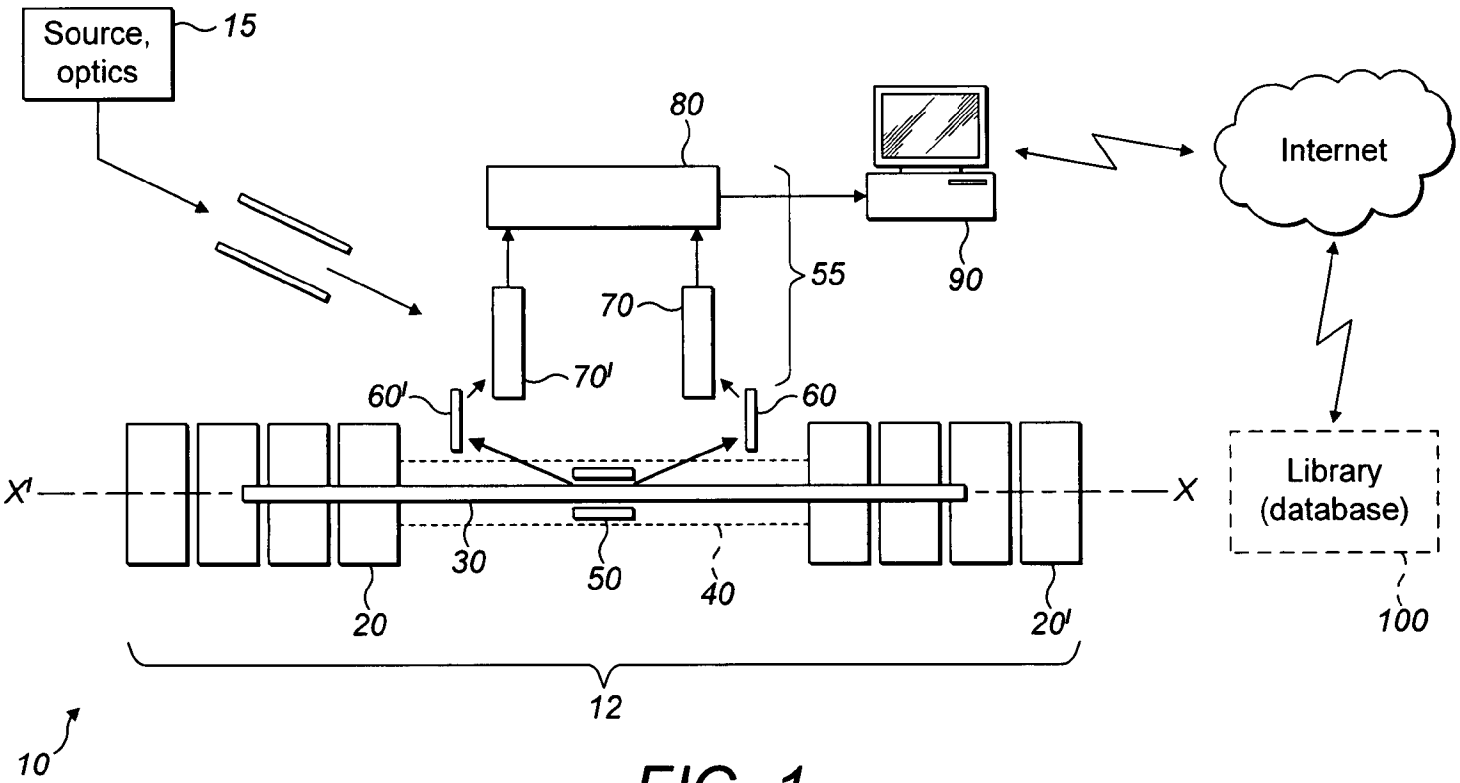
FIG. 1 shows an apparatus for the identification of microbiological organisms in accordance with a first embodiment representing the present invention.

Referring first to FIG. 1, a multi-reflection time of flight (MR TOF) mass spectrometer instrument 10 is shown. The instrument 10 comprises a closed mirror MR TOF arrangement indicated generally by reference numeral 12 and an ion detection arrangement shown generally at reference numeral 55.

Ions are generated at an ion source and then guided using ion optics toward the closed mirror MR TOF 12. The ion source and optics is shown generally at reference numeral 15 in block form. The specific arrangement of the ion source and ion optics does not form a part of the present invention and in any event will be familiar to those skilled in the art. The ion source is, in preference, a matrix assisted laser desorption ionization (MALDI) source, although other ion sources such as an electrospray source may be used. As of 2011, bacterial electrospray ionization is not an established technique, however.

Ions generated by the ion source and guided by the ion optics 15 are directed toward a reflection axis XX' of the closed mirror MR TOF arrangement 12. This axis is established between a first ion mirror 20 and a second ion mirror 20' respectively. Ions from the source can enter the XX' axis either using a small deflector or axially by turning off one of the mirrors. The on-axis injection can accept a larger mass range, but there can be voltage stability problems on the mirror that is being turned on/off Once injected into the closed mirror MR TOF arrangement 12, ions move back and forth between the first and second ion mirrors 20, 20' along the axis XX' and this is indicated by the ion beam 30 in FIG. 1.

The closed mirror MR TOF arrangement 12 also includes a shield 40 for the ion beam 30.

Between the first and second ion mirrors 20, 20' is an ion deflector device 50 the purpose and preferred configuration of which will be explained in more detail below. The ion deflector device 50 is bi-directional; that is, it is arranged to deflect ions travelling from the first ion mirror 20 toward the second ion mirror 20' and hence in a left to right direction as seen in FIG. 1, off the axis XX' and out of the closed mirror MR TOF arrangement 12, and also to deflect ions travelling in the opposite direction between the second ion mirror 20' and the first ion mirror 20 in a right to left direction as seen in FIG. 1, out of the closed mirror MR TOF arrangement 12.

Ions deflected off the mirror axis XX' in FIG. 1 by the bi-directional ion deflector device 50 enter the ion detector arrangement 55 where they may be detected. In the specific arrangement of FIG. 1, ions travelling in a left to right direction between the first and second ion mirrors 20, 20' respectively as viewed in FIG. 1 are deflected by the ion deflector device 50 toward a first conversion dynode or post accelerating dynode 60. As will be well understood by those skilled in the art, secondary emission occurs at the surface of the first dynode 60. The secondary electrons from the first dynode 60 in turn impinge upon a first electron multiplier 70 which creates an electron shower. The shower of electrons ends at an anode (not shown) of the electron multiplier 70, and that anode is in turn connected to a digitizer 80, either directly when it is at ground potential, or for example by the use of capacitive or inductive coupling when it is floated (above ground potential). The electron multiplier 70 may also be formed as a combination of an electron amplifier and a photon amplifier (eg by the use of micro-channel plates or an electron multiplier followed by a scintillator which converts the electrons into photons, followed by one or two photomultipliers which combine the photon outputs).

Meanwhile, ions travelling from right to left along the axis XX' of the closed mirror MR TOF arrangement 12, that is, between the second and the first ion mirrors 20', 20 are deflected by the ion deflector device 50 toward a second conversion dynode or post accelerating dynode 60' located away from the first dynode 60. This second dynode 60' in turn generates secondary electrons which impinge upon a second electron multiplier 70'. The secondary electrons are multiplied by the second electron multiplier 70' to produce a parallel electron shower which is (as explained above) captured by an anode of the second electron multiplier 70' which is in turn directly or indirectly coupled to a digitizer 80. Thus, the digitizer 80 receives an incident current representative of ions travelling in both directions in the closed mirror MR TOF arrangement 12 when they are ejected from it by the ion deflection device 50.

The signal representative of the abundance of ejected ions, is digitised and collected by a computer 90. The computer may be a dedicated part of the multi-reflection time of flight instrument 10 or may, alternatively, be a separate, standalone personal computer, for example, in wired or wireless communication with a data port (not shown) of the instrument 10. The computer 90 is directly or indirectly in communication with a separate library or database of information, for example, via the interne. Again this feature of preferred embodiments of the present invention will be explained in further detail below.

In use of the arrangement of FIG. 1, ions are injected as a short pulse into the closed mirror MR TOF arrangement 12 where they oscillate multiple times between the first and second ion mirrors 20, 20' along the axis XX'. The ions are injected at an arbitrary time $t_0$ and are allowed to move back and forth multiple times, thus extending the effective path length of the ions. Ions of different mass to charge ratios travel at different velocities within the closed mirror MR TOF arrangement 12 and thus separate in time of flight to form a series of ion packets.

After ions have made multiple traverses of the closed mirror MR TOF arrangement 12, at a second time $t_1$ ($>t_0$), the ion deflector device 50 is energised to cause ions travelling along the axis XX' to be deflected off that axis to the ion deflector arrangement 55 as explained above. Of course, the ions at time $t_1$ are not in an infinitely narrow bunch but are instead separated out along the axis XX'. Thus there will be a finite time for ions to be emptied from the trap after the time $t_1$ as the separate ion packets arrive one after the next at the ion deflector 50, so that the first ion packet may arrive at time $t_1$ with subsequent packets at $t'_1$, $t''_1$, $t'''_1$ (where $t'_1$ $t''_1$ $t'''_1 > t_1$). For ease of explanation, however, in the following description we reference a single ejection time (eg, $t_1$) but it is to be understood that this time simply denotes the start (or a mean) of the time window during which ions are ejected from the MR TOF.

Because the ion deflector device 50 is bi-directional, essentially all ions within the closed mirror MR TOF arrangement 12 can be ejected starting at that time $t_1$. The time difference between the injection of ions into the MR TOF and the start of ejection from the trap ($t_1 - t_0$) is referred to hereinafter as the ion residence time within the closed mirror MR TOF arrangement 12.

Because of the above mentioned ion separation within the closed mirror MR TOF arrangement 12, a series of ion packets is ejected from the mirror axis XX'. The relative quantity of ions within each packet is directly proportional to the signal detected by the ion detector arrangement 55. In other words, the detector arrangement 55 produces a series of peaks of different intensities, each intensity being proportional to the relative abundance of ions in each ion packet.

In contrast to the prior art, however, and as explained in the Summary of Invention, the inventor has recognised that, although each peak is of course a consequence of ions of a specific mass to charge ratio, accurate identification of a bacterial species does not however require each peak to be assigned a mass (that is, no mass spectrum need be produced). Instead, it is simply necessary that the minimum residence time of any ions within the closed mirror MR TOF arrangement 12 ($t_1 - t_0$) is sufficiently long that the different ion species can properly separate so that separate peaks can be adequately discriminated. The only other requirement is that the ion species are ejected in a particular order. The reason for this is that, because ions of different mass to charge ratios oscillate within the closed mirror MR TOF arrangement 12 at different frequencies, the relative positions of different packets of ions (separated in accordance with their mass to charge ratio) will be different at different times $t_1$, $t_2$, $t_3$, and so forth after $t_0$. Note that this does not necessarily mean that the time $t_1$ must always be the same; indeed in particularly preferred aspects of the present invention multiple residence times may be employed, and equally spectra can be produced using different residence times. However it must be possible to map one such spectrum to another through knowledge of the residence time or a parameter associated with or derivable from it. The reason for the requirement for consistency is so that the generated biological fingerprint can be compared like-for-like with equivalent spectra in a library or database of bio-fingerprints which has been established using known micro-organisms.

Figure 5:
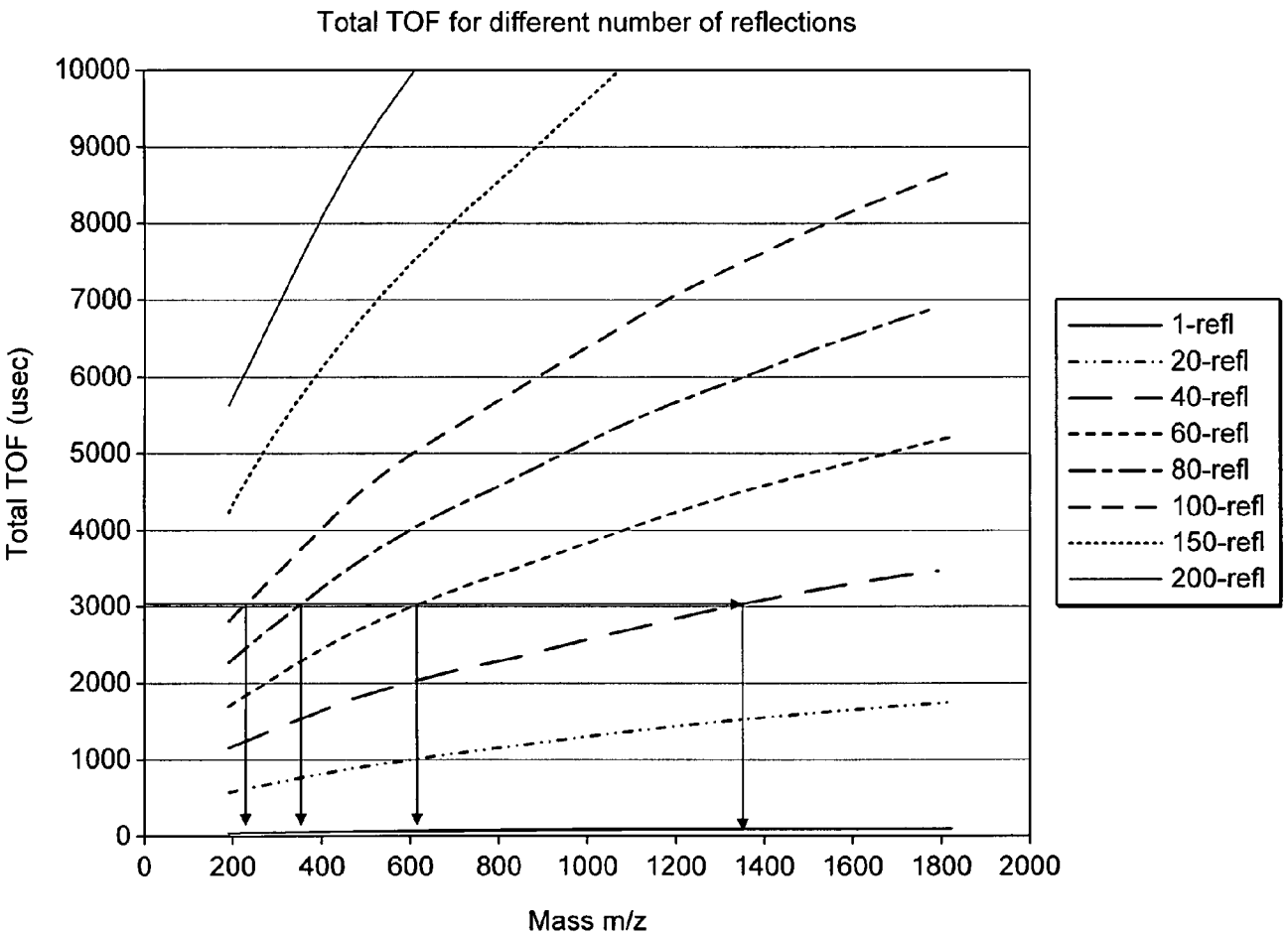
FIG. 5 shows a schematic plot of Time of Flight against m/z, for multiple different numbers of reflections, in an apparatus of FIGS. 1-4.

The principle embodying the present invention may better be understood by reference to FIG. 5 which is a schematic plot of total time of flight versus m/z for different numbers of reflections. As may be discerned from FIG. 5, at, for example, a total TOF of 3 ms (i.e. $t_1$-$t_0$=3 ms), a number of ions can coincide: for example ions of m/z just higher than two hundred that have undergone 100 reflections will coincide at the ion deflector with ions having an m/z just over 350 and which have undergone 80 reflections, as well as with ions having m/z=600 and having undergone 60 reflections. Ions of many other m/z having had different numbers of reflections will also coincide. For clarity, only reflections 1, 20, 40, 60 . . . are shown in FIG. 5, but also coincidence of ions of other m/z having undergone 2, 3, 4, 5, 6 . . . 21, 22, 23, . . . reflections exists. However, it should be noted that not all ions will necessarily coincide, particularly at high resolution, because the m/z is not a continuum, and not all combinations of ions will exist within a spectrum.

Thus, the spectrum which is produced does not assign mass numbers but is instead a "spectral fingerprint" or "bio-identifier" where the vertical axis of the spectrum is still peak intensity but the X axis is no longer mass, mass to charge ratio or time of flight (which, of course, is linked to m/z). It is some arbitrary spectral or fingerprint coordinate with the only requirement being that it is at least consistent or consistently known.

Figure 6A:
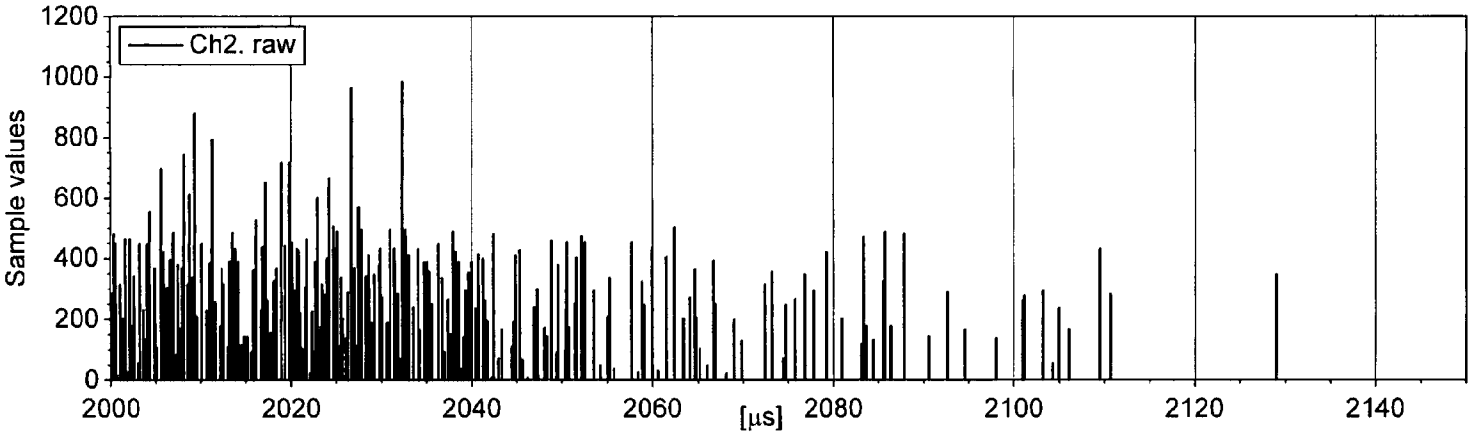
FIGS. 6*a* and 6*b* show, respectively, a simulated fingerprint and a close up part thereof.
Figure 6B:
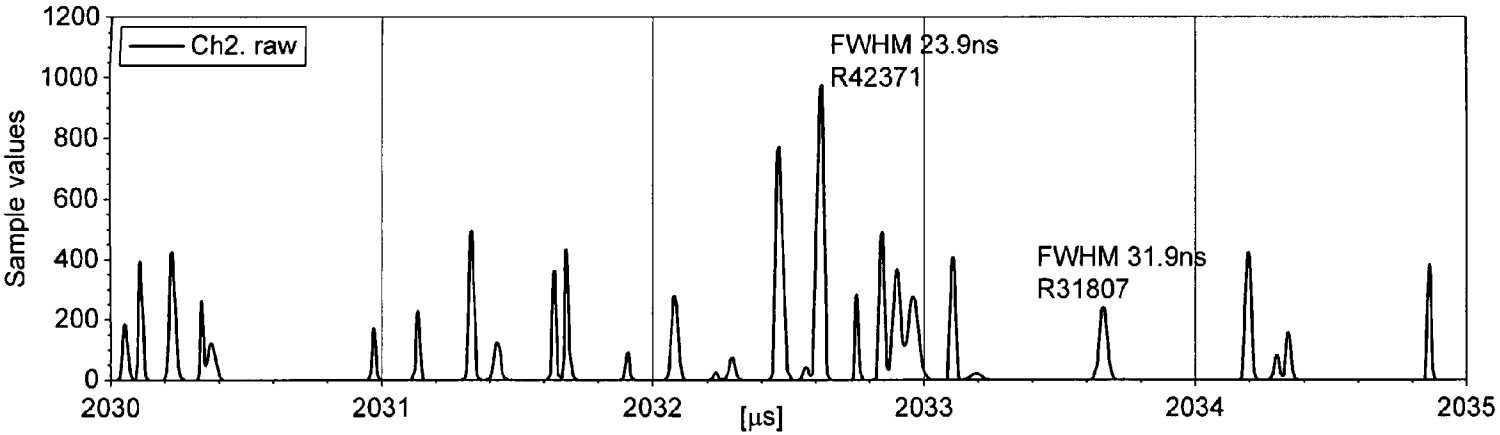

FIGS. 6*a* and 6*b* show, respectively, a simulated fingerprint and a close up part thereof. In each Figure, the vertical (y) axis represents the abundance of a given ion derived from the sample, in arbitrary units. The horizontal (x) axis is time units; in the present example the time is that from injection of the sample into the MR TOF to ejection therefrom and subsequent detection (which is why the origin is at 4 milliseconds, rather than zero). The fingerprint of FIGS. 6*a* and 6*b* is not from a real biological sample but is instead simulated using pseudorandom data from proteomics experiments, to illustrate the principles of the present invention. In FIG. 6*a*, approximately 500 peaks are shown though normally a much smaller number of peaks is obtained since a much smaller number is typically sufficient for accurate identification of a sample when compared with a reference fingerprint in a database.

The peaks in FIG. 6*a* correspond to a mass range from 400 to 24,000 Da though, as will be understood, the peaks are arranged in order of ejection from the MR TOF after the time $t_1$ rather than in ascending or descending order of m/z.

It should be noted that the very wide simulated peaks (seen in FIG. 6*b*) are much wider than would be found in a real instrument, where the FWHM of the peaks would typically be expected to be of the order of 1 ns up to 10 ns (in comparison with the typical sub nanometer peak width in a traditional TOF device).

Figure 2:
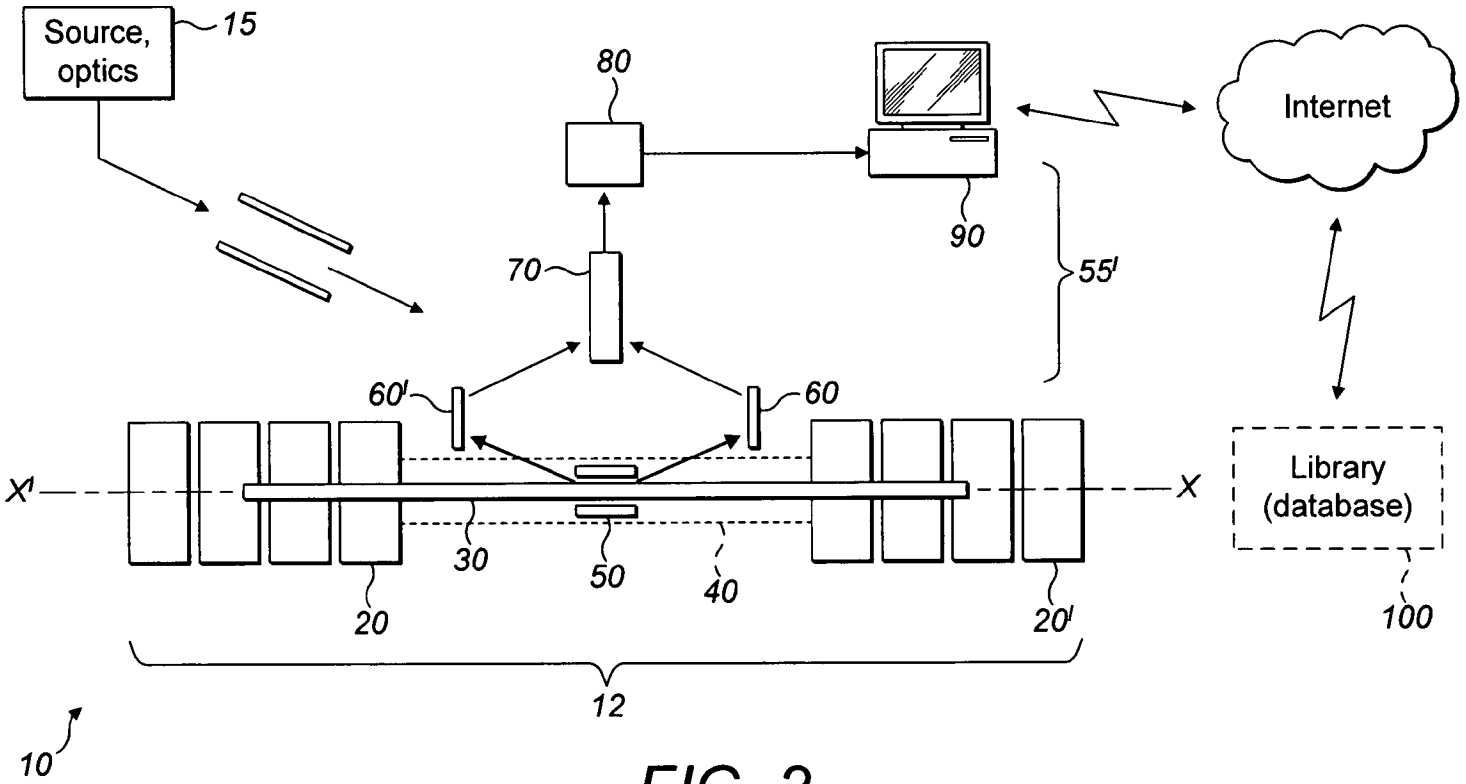
FIG. 2 shows an apparatus for the identification of microbiological organisms in accordance with a second embodiment representing the present invention.
Figure 3:
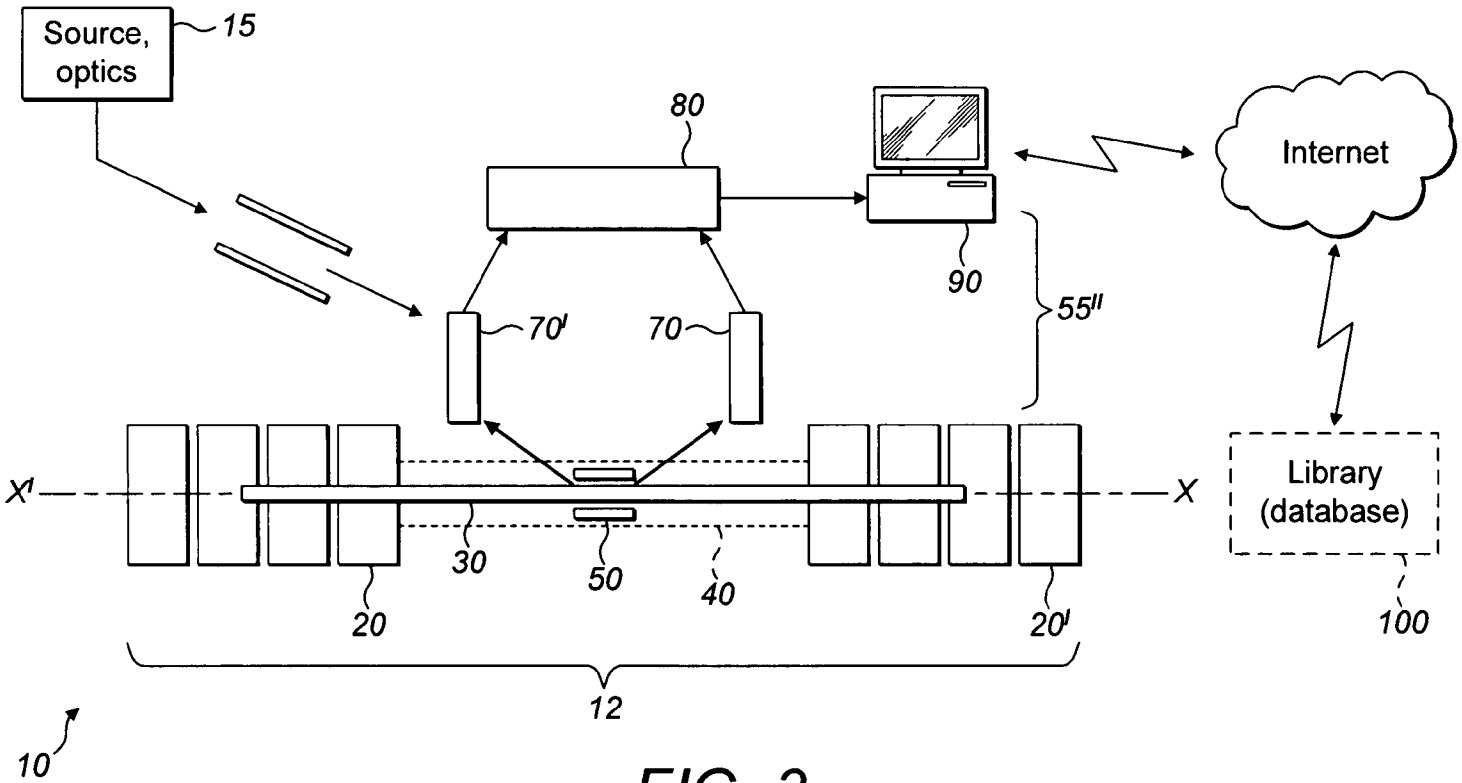
FIG. 3 shows an apparatus for the identification of microbiological organisms in accordance with a third embodiment representing the present invention.
Figure 4:
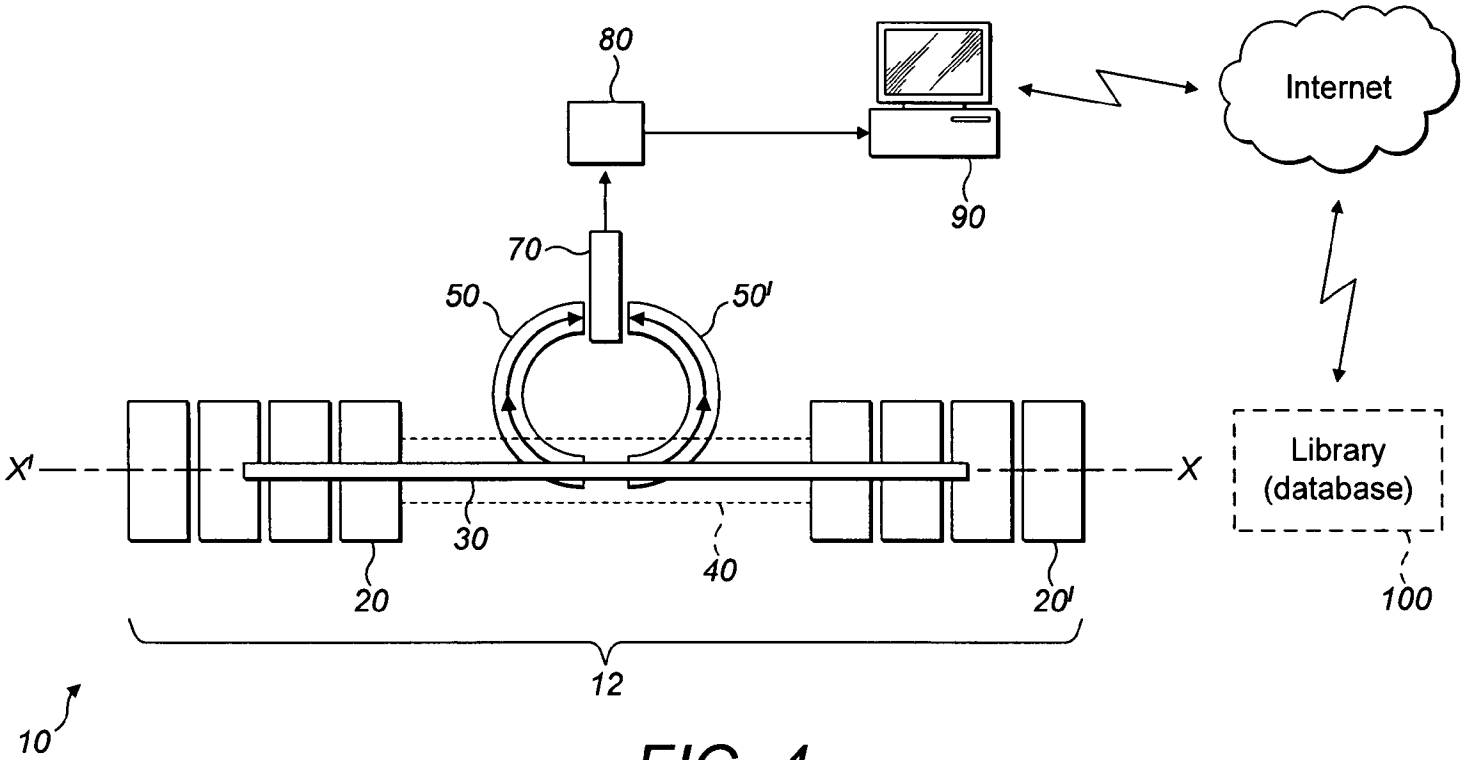
FIG. 4 shows an apparatus for the identification of microbiological organisms in accordance with a fourth embodiment representing the present invention.

FIGS. 2 to 4 show alternative arrangements of instruments 10 for producing either reference or sample spectral fingerprints. Many of the components of FIGS. 2 to 4 correspond with the components of FIG. 1 and thus are labelled with like reference numerals.

In FIG. 2, the closed mirror MR TOF arrangement 12 is identical with that of FIG. 1 and as described in connection with that Figure. The ion detector arrangement 55' of FIG. 2 is, however, different to that of FIG. 1. In the arrangement of FIG. 2, the ion detector arrangement comprises still first and second conversion dynode or post accelerating dynodes 60, 60' to receive, respectively, ions deflected off the ion axis XX' in each direction. In contrast to the arrangement of FIG. 1, however, in FIG. 2 each dynode 60, 60' generates secondary electrodes which impinge upon a single electron multiplier 70 which in turn produces secondary electrons that are detected by a digitizer 80. This digitizer in turn communicates with the computer 90.

In the arrangement of FIG. 3 which represents still an alternative instrument 10 embodying the present invention, again the closed mirror MR TOF arrangement 12 is identical with that shown in FIGS. 1 and 2. This time, however, the ion detector arrangement 55" does not include any conversion dynodes. Post accelerating dynodes are also not shown in the specific arrangement of FIG. 2, though in practice the use of post acceleration may remain desirable since it is beneficial for the detection of ions of relatively high m/z.

In the embodiment of FIG. 2, ions are deflected off the mirror axis XX' onto respective first and second electron multipliers 70, 70'. These in turn each produce showers of secondary electrons which are detected by a single digitizer 80. The computer collects the data digitized by the digitizer 80.

Finally, in FIG. 4 the ion deflector device 50 is comprised of first and second opposed electric sector instruments which, when energised, take ions off the mirror axis XX' travelling in opposite directions and direct each onto a single electron multiplier 70. This single electron multiplier in turn produces a single shower of secondary electrons for digitization by the digitizer 80 and subsequent collection by the computer 90.

The manner of compilation of the database and its use in the identification of sample microorganisms will now be described. To create a fingerprint of a known microorganism, a sample of that microorganism is analysed using the techniques above, preferably in an instrument 10 such as is shown in FIGS. 1 to 4 but optionally in a conventional arrangement of a TOF spectrometer instead, where the resolution of that conventional TOF is broadly comparable to that of the device of FIGS. 1-4. Whilst the parameters of the closed mirror MR TOF arrangement 12 preferably used to obtain a spectral fingerprint for the known microorganism may be fixed (that is, for example, separation between the first and second ion mirrors 20,20' may be always the same), this is not necessary. All that is necessary is that the spectral parameters are at least known so that the reference spectral fingerprints that are created using the known microorganisms can be mapped if necessary onto sample fingerprints created using instruments having different parameters. One way of achieving this is by employing an internal calibrant along with the sample microorganism so that calibrant peaks (or lock masses) appear within the spectral fingerprint. In preference, two or more lock mass compounds are employed. By doing this it is always possible to deconvolute different spectra/fingerprints to a standardized or comparable form. The mapping is typically carried out in software. The use of lock masses to assist in peak mapping will be described further below in connection with FIG. 8.

Likewise it will be understood that the database or library of known microorganisms and their spectral fingerprints may be very large (both in terms of the number of microorganisms kept in the database, and the volume of computer data thus generated). As such it may be neither practical nor desirable for the database or library or known microorganisms to be held locally on, for example, the hard drive of the computer 90. Instead, it may be preferable to maintain the library at a central repository for remote access, for example via the internet. This is shown schematically in FIGS. 1 to 4. The database may be in a different country to the instrument 10, of course.

Once the database or library has been established, a sample of a microorganism to be identified is analyzed using the instrument 10 of FIGS. 1 to 4. That analysis generates a spectral fingerprint in the manner described previously. The sample fingerprint produced at the computer 90 is then sent via the internet for comparison, at the library 100, with the fingerprints of various known microorganisms and a result may be returned to the computer 90 from the library 100 again using the internet. Where conversion needs to take place because the parameters used to generate the sample fingerprint are different to those used to generate the reference fingerprints, conversion may take place either locally at the computer 90 or locally to the library/database 100 or elsewhere. The results of the comparison may be provided in known manner as a series of potential (known) microorganism ranked in order of likelihood of match between the sample microorganism and the known microorganisms in the library 100.

Although a single comparison of a sample spectral fingerprint with a corresponding or mapped library spectral fingerprint is effective, in a preferred embodiment two or more spectral fingerprints of a sample microorganism, taken using different residence times within the closed mirror MR TOF arrangement 12, are obtained. Provided each spectral fingerprint, from the same sample with different residence times, can be mapped to equivalent multiple reference spectral fingerprints in the database 100, then additional confidence in a match (or otherwise) can be achieved. For example, with multiple ion species, at any given residence time, there is a possibility of two ion species of completely different mass to charge ratios overlapping at the point where the ions are ejected, even though one of these ion species will have traversed the closed mirror MR TOF arrangement 12 a different number of times to the other ion species. By employing multiple residence times, the chance of this overlap occurring in both cases is significantly reduced or removed entirely.

Figure 7A:
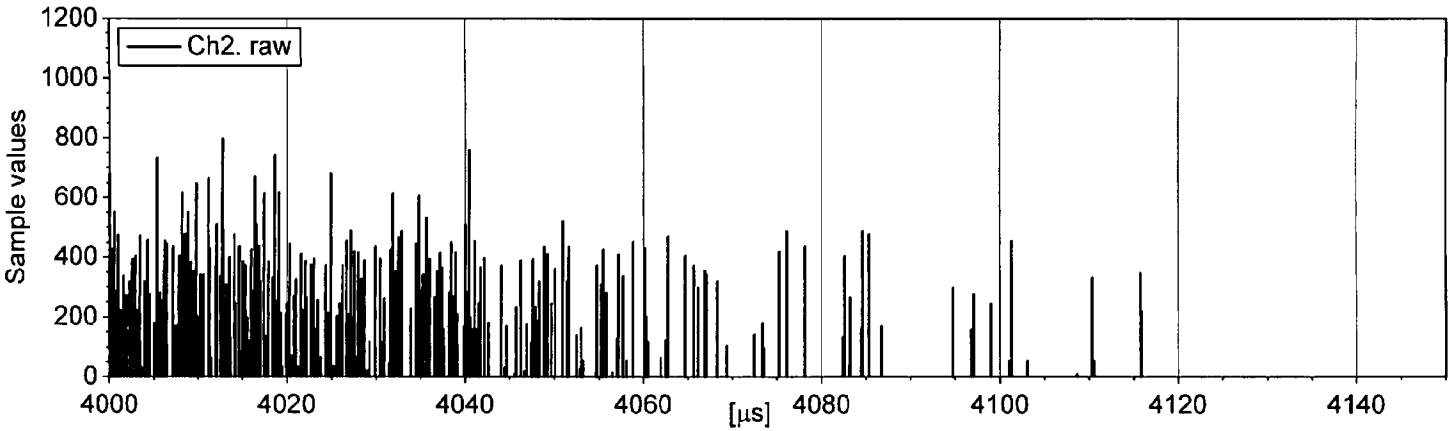
FIGS. 7*a* and 7*b* show, respectively, simulated fingerprints with two different ion residence time.
Figure 7B:
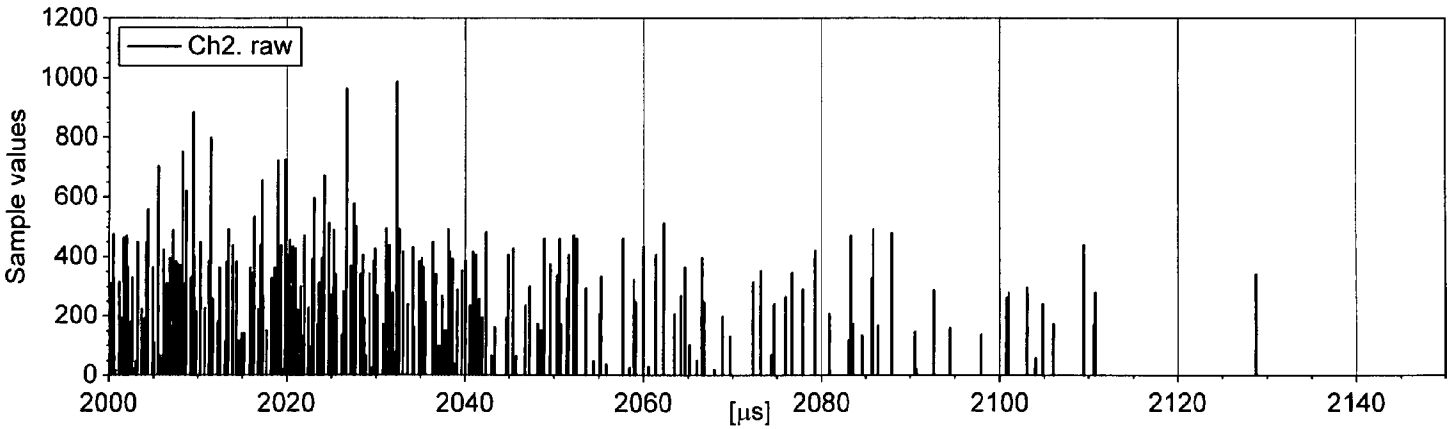

This principle may be better understood by reference to FIGS. 7*a* and 7*b* which show, respectively, simulated fingerprints with 2 different ion residence times. Because in the fingerprint of FIG. 7*b* (residence time no less than 4 milliseconds, that is, the ions move back and forth in the trap between the ion mirrors for at least 4 milliseconds before the deflectors are energized to empty the trap), the ions reside in the trap for longer than in the case of FIG. 7*a* (minimum residence time 2 milliseconds), specific ion species will be at different relative positions in the trap in each case as the deflectors are energized. To take a specific example, in the fingerprint of FIG. 7*b* (minimum ion residence time 4 milliseconds), peaks corresponding to ions having m/z=2722.387 and m/z=3961.83 each arrive at the deflectors at t=4,040,597.7 ns, though travelling in opposite directions into the bidirectional deflector. Since they arrive at the same time, they would be difficult to discriminate.

However by repeating the experiment and generating a fingerprint with a minimum residence time of only 2 milliseconds, the peaks from the ions having m/z=2722.387 and m/z=3961.83 arrive at the bidirectional deflector at 2,020,299 ns and 2,020,367 ns respectively (and hence will be well discriminated). Algorithms can be constructed to use data from two (or more, of course) fingerprints derived from the same sample but using different minimum residence times, to allow disambiguation of overlapping peaks in one or other of those fingerprints.

Figure 8:
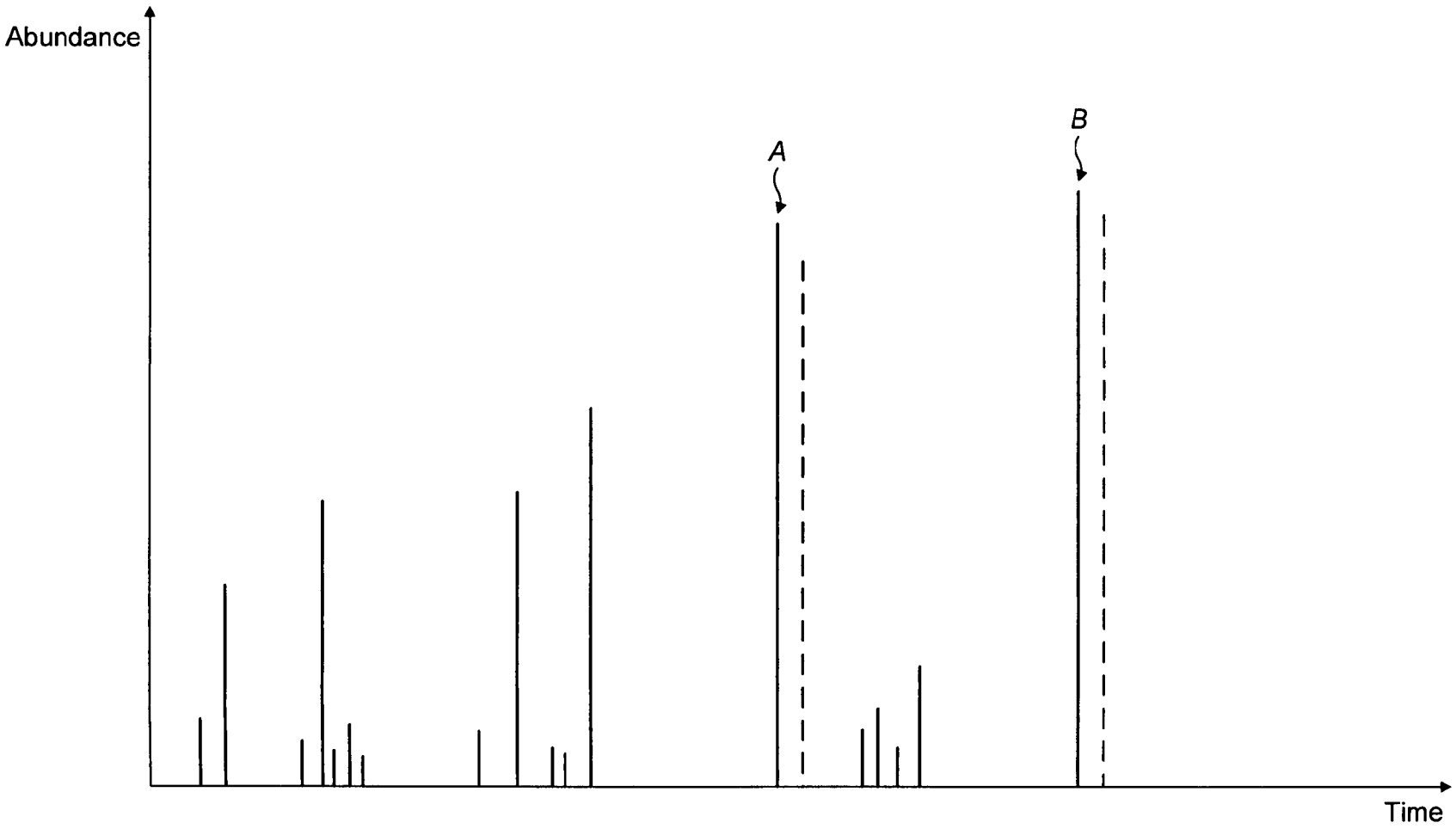
FIG. 8 shows a schematic illustration of a fingerprint in accordance with an embodiment of the present invention.

FIG. 8 shows a schematic illustration of a part of a fingerprint in accordance with an embodiment of the present invention. The partial fingerprint in FIG. 8 is not simulated from pseudorandom data or the like but simply illustrates a possible configuration of peaks without attempting to show the peak width since this is not germane to the present explanation. As introduced above, it is possible and indeed desirable to introduce one or more lock masses along with the sample to be identified. Lock masses are ions of known m/z with well defined peaks of sufficient abundance to provide a clear point of reference in a mass spectrum. In the context of the present invention, one or more (preferably more than one) lock mass is used. The purpose is not to improve a mass spectrum per se, since, as will be understood, the fingerprints of the present invention are not mass spectra but instead representations of ion abundance for each sample and lock mass ion, plotted against some arbitrary figure such as ejection time and with the ions arranged in order of ejection from the trap or in an order mapped to the order of ejection from the trap. The lock mass(es) instead allow corrections to be applied to the position of the various peaks in either or both of the x (ejection time, for example) and y (abundance) axes, since any shift in the x and/or y direction of measured lock mass peaks from their expected abundance/time can be used to apply a correction to the other peaks of unknown origin.

This principle can be seen from the peaks labelled A and B in FIG. 8; each is shifted (both in height and time) from the expected position which is illustrated with a broken line. That shift can be used to provide a correction factor for all of the other peaks.

Although in some embodiments lock masses are employed simply to allow a correction of a fingerprint on the basis that each of the peaks therein (from both lock mass ions and sample ions) is of measured abundance and ejection time, by using multiple lock masses it is further possible, in accordance with other embodiments of the present invention, to forego the need to measure ejection times of sample ions entirely. Instead, such ejection times can be inferred from the determined position of the lock masses.

Although some specific embodiments have been described, various modifications are envisaged. For example, rather than the single ion deflector device of FIGS. 1 to 4, a combination of deflectors could be employed, for example in a dog leg arrangement. It will also be appreciated that the deflectors do not need to be precisely in the middle of the ion mirrors; they could be offset to one or other side. Moreover the mirrors themselves need not be identical.

The techniques described may equally be employed in a multi-turn time of flight mass spectrometer ("MULTUM") as developed at Osaka University and described, for example, J. Mass Spectrom. Volume 38, 2003, pages 1125-1142, by Toyoda et al. This device is of a figure of eight arrangement and may be easier to empty since it is necessary that only one of the electric sectors is switched off to do that.

Furthermore, although specific embodiments have been described in the generation of spectral fingerprints for bacteria and moulds, the technique is envisaged to be applicable to other bio samples as well. The resolution is certainly sufficient to allow analysis of bacterial strains as well as species.

The invention claimed is:

1. A method of identifying a sample comprising:

(a) generating sample ions from the sample to be identified;

(b) introducing at a time $t_0$ the sample ions into a sample multi-pass time of flight (TOF) mass spectrometer and causing at least some of the ions to travel repeatedly along a path in the TOF mass spectrometer where ions of different m/z separate in time of flight and further wherein ions of at least a first m/z overtake ions of at least a second, different m/z;

(c) ejecting the sample ions from the sample TOF mass spectrometer starting at a time $t_1$ ($>t_0$);

(d) detecting the ejected ions;

(e) generating a first sample fingerprint which comprises a plurality of peaks, each peak arising from ions of a particular mass to charge ratio and being arranged in sequential relation to their order of ejection from the sample TOF mass spectrometer at or following $t_1$ but wherein at least some of the peaks are not arranged in sequential order of m/z, the first sample fingerprint being comparable with a library of reference fingerprints from samples of known identity, for identification of the sample; and (f) comparing the obtained first sample fingerprint with a library of reference fingerprints.

2. The method of claim 1 wherein the sample is a microorganism and the library is a library of reference fingerprints of known microorganisms.

3. The method of claim 1, further comprising: identifying the sample when a match or best fit of the sample fingerprint to a reference fingerprint from a one of the known samples in the library is obtained.

4. The method of claim 1, wherein the peaks are separated in relation to the time of ejection from the sample TOF mass spectrometer.

5. The method of claim 1, wherein the library of reference fingerprints from samples of known identity is generated using one or more reference TOF mass spectrometer(s) having substantially the same spectrometer parameters as the sample TOF mass spectrometer employed to identify the sample, the residence time of sample ions in the sample TOF mass spectrometer, being defined as the period between injection of sample ions into the sample TOF mass spectrometer and commencement of ejection therefrom, $(t_1-t_0)$, being substantially the same as the residence time of ions from the known sample used to generate the library of reference fingerprints in the reference TOF mass spectrometer(s).

6. The method of claim 1, wherein the library of reference fingerprints from samples of known identity is generated using one or more reference TOF mass spectrometer(s) having different spectrometer parameters to the sample TOF mass spectrometer employed to identify the sample, the method further comprising applying a correction algorithm to the sample fingerprint and/or the reference fingerprint so that the effective residence time of sample ion species in the sample TOF mass spectrometer, being defined as the period between injection of sample ions into the multi pass sample TOF mass spectrometer and commencement of ejection therefrom, time $(t_1-t_0)$, adjusted for differences in spectral parameters between the sample TOF mass spectrometer and the reference TOF mass spectrometer(s), is the same as that of and reference ion species in the reference TOF mass spectrometer(s).

7. The method of claim 1, further comprising:

(f) introducing, at a time $t_2$ ($\neq t_0$; $t_1$) further sample ions generated from the sample into the sample TOF mass spectrometer;

(g) ejecting the further sample ions from the sample TOF mass spectrometer starting at a time $t_3$ ($>t_2$), wherein a second residence time of the further sample ions in the sample TOF mass spectrometer, defined as the period between injection of the further sample ions into the sample TOF mass spectrometer and commencement of ejection of those further sample ions therefrom, $(t_3-t_2)$, is different from the residence time of those sample ions $(t_1-t_0)$ used to generate the first fingerprint;

(h) detecting the ejected further sample ions; and (i) generating a second sample fingerprint, which is also comparable with the library of reference fingerprints from samples of known identity.

8. The method of claim 1, wherein the sample TOF mass spectrometer includes first and second ion mirrors arranged so as to oppose each other so as to form a closed path for ion travel having an axis of reflection, the sample TOF mass spectrometer further comprising a bi-directional deflector arrangement located along the said axis of reflection; the method further comprising:

deflecting sample ions travelling along the axis of reflection in a first direction from the first to the second ion off the axis of reflection, using the bi-directional deflector arrangement, towards a detector arrangement for detection starting at the time $t_1$ deflecting sample ions travelling along the axis of reflection in a second direction from the second to the first ion off the mirror axis of reflection, using the bi-directional deflector arrangement, towards the detector arrangement for detection also starting at the time $t_1$.

9. The method of claim 7, wherein the sample TOF mass spectrometer includes first and second ion mirrors arranged so as to oppose each other so as to form a closed mirror having an axis of reflection, the sample TOF mass spectrometer further comprising a bi-directional deflector arrangement located along the axis of reflection; the method further comprising:

deflecting sample ions travelling along the axis of reflection in a first direction from the first to the second ion mirror off the axis of reflection, using the bi-directional deflector arrangement, towards a detector arrangement for detection starting at the times $t_1$ and $t_3$;

deflecting sample ions travelling along the axis of reflection in a second direction from the second to the first ion mirror off the axis of reflection, using the bi-directional deflector arrangement, towards the detector arrangement for detection starting at the times $t_1$ and $t_3$.

10. The method of claim 8, wherein the detector arrangement comprises first and second detectors, the method further comprising deflecting the sample ions travelling in the first direction towards the first detector while deflecting the sample ions travelling in the second direction towards the second detector.

11. The method of claim 10, further comprising post accelerating the ions in the detectors.

12. The method of claim 1, wherein the sample TOF mass spectrometer includes a plurality of electric and/or magnetic sectors arranged so as to form a closed race track or Figure of Eight path for ion travel, the sample TOF mass spectrometer further comprising a deflector arrangement located along the said ion travel path; the method further comprising:

deflecting sample ions travelling along the ion travel path, using the deflector arrangement, towards a detector arrangement for detection at or following the time $t_1$.

13. The method of claim 1 further comprising introducing lock mass ions, each having a known identity and residence time in the sample TOF mass spectrometer, together with the sample ions, the step (d) of detecting the ejected ions comprising detecting both the sample ions and the lock mass ions, and the step (e) comprising generating a sample fingerprint including peaks derived from both the sample ions and the lock mass ions.

14. The method of claim 13, further comprising using the known identity and residence time of the lock mass ions to correct the position and/or height of the sample peaks in the fingerprint.

15. A multi reflection time of flight (MR TOF) mass spectrometer for identifying a sample comprising:

an ion source for generating sample ions;

a closed mirror MR TOF arrangement having first and second ion mirrors located so as to oppose each other along an axis of reflection;

a bi-directional ion deflector arrangement positioned along the axis of reflection and configured:

(i) to deflect sample ions introduced into the closed mirror MR TOF arrangement from the ion source and travelling along the axis of reflection in a first direction from the first to the second ion mirror to an ion detector arrangement, starting at a time $t_1$ after introduction into the closed mirror MR TOF arrangement; and (ii) to deflect sample ions introduced into the closed mirror MR TOF arrangement from the ion source and travelling along the axis of reflection in a second direction from the second to the first ion mirror to the ion detector arrangement also starting at the time $t_1$.

16. The MR TOF mass spectrometer of claim 15, wherein the detector arrangement includes a data collecting means configured to acquire a sample fingerprint comprised of a plurality of data peaks, each peak arising from ions of a particular mass to charge ratio and being arranged in sequential relation to their order of ejection from the closed mirror MR TOF arrangement at or following $t_1$ but wherein at least some of the peaks are not arranged in sequential order of m/z.

17. The MR TOF mass spectrometer of claim 16, wherein the bi-directional ion deflector arrangement is positioned substantially mid way between the first and second ion mirrors along the axis of reflection.

18. The MR TOF mass spectrometer of claim 16, wherein the ion detector arrangement includes first and second ion detectors, the first ion detector being arranged to detect sample ions deflected by the bi-directional ion deflector and which had been travelling in the said first direction in the closed mirror MR TOF arrangement immediately prior to deflection, the second ion detector being arranged to detect sample ions deflected by the bi-directional ion deflector and which had been travelling in the said second direction in the closed mirror MR TOF arrangement immediately prior to deflection.

19. The MR TOF mass spectrometer of claim 18, wherein the first detector comprises a first conversion or post acceleration dynode upstream of a first electron multiplier, and the second detector comprises a second conversion or post acceleration dynode upstream of a second electron multiplier, the detector arrangement further comprising a digitizer for digitizing the outputs of the first and second electron multipliers, the data collecting means communicating with the digitizer for acquisition of the said sample fingerprint.

20. The MR TOF mass spectrometer of claim 18 wherein the first detector comprises a first conversion or post acceleration dynode, wherein the second detector comprises a second conversion or post acceleration dynode, and wherein the ion detector arrangement further comprises an electron multiplier downstream of the first and second dynodes and a digitizer for digitizing the output of the electron multiplier, the data collecting means communicating with the digitizer for acquisition of the said sample fingerprint.

21. The MR TOF mass spectrometer of claim 18, wherein the first detector comprises a first electron multiplier, wherein the second detector comprises a second electron multiplier, the ion detector arrangement further comprising a digitizer for digitizing the outputs of the first and second electron multipliers, the data collecting means communicating with the digitizer for acquisition of the said sample fingerprint.

22. The MR TOF mass spectrometer of claim 15, wherein the bi-directional ion deflector is a two way electric sector ion deflector.

23. The MR TOF mass spectrometer of claim 15, wherein the ion source is a matrix assisted laser desorption ionization (MALDI) ion source.

24. The MR TOF mass spectrometer of claim 15, wherein the ion detector arrangement includes first and second ion detectors, and wherein the first and/or second detector includes post acceleration means.

25. The MR TOF mass spectrometer of claim 15, wherein the ion detector arrangement includes first and second ion detectors, and wherein the first and/or second detector comprises or includes a combination of a plurality of amplification devices.

26. A method of generating a reference fingerprint for a database of reference fingerprints representing a plurality of different reference samples, comprising:

(a) generating reference ions from the reference sample;

(b) introducing at a time $t_0$ the reference ions into a multi-pass TOF mass spectrometer and causing at least some of the ions to travel repeatedly along a path in the TOF mass spectrometer where ions of different m/z separate in time of flight and further wherein ions of at least a first m/z overtake ions of at least a second, different m/z;

(c) ejecting the reference ions from the TOF mass spectrometer starting at a time $t_1$ ($>t_0$);

(d) detecting the ejected ions;

(e) generating the reference fingerprint of the reference sample, wherein each peak of the reference fingerprint arises from ions of a particular mass to charge ratio and is arranged in sequential relation to their order of ejection from the TOF mass spectrometer at or following $t_1$ but wherein at least some of the peaks are not arranged in sequential order of m/z, the reference fingerprint being comparable with a sample fingerprint from a sample to be identified, to determine whether the sample fingerprint is a match to the generated reference fingerprint; and (f) comparing the obtained first sample fingerprint with a library of reference fingerprints.

27. The method of claim 26 wherein the reference sample and the sample to be identified are each a microorganism.

28. The method of claim 26, further comprising:

saving the generated reference fingerprint to a database or library of reference fingerprints representing a plurality of different samples.

* * * * *

UNITED STATES PATENT AND TRADEMARK OFFICE

CERTIFICATE OF CORRECTION

PATENT NO. : 9,099,287 B2
APPLICATION NO. : 14/128189
DATED : August 4, 2015
INVENTOR(S) : Giannakopulos It is certified that error appears in the above-identified patent and that said Letters Patent is hereby corrected as shown below:

On the title page

Item (54), column 1, line 1, delete "TIMEOF" and insert -- TIME OF --, therefor.

Item (57), column 2, line 1, delete "MRTOF" and insert -- MR TOF --, therefor.

Item (57), column 2, line 2, delete "And" and insert -- and --, therefor.

Item (57), column 2, line 3, delete "MRTOF" and insert -- MR TOF --, therefor.

Item (57), column 2, line 6, delete "MRTOF" and insert -- MR TOF --, therefor.

Item (57), column 2, line 11, delete "MRTOF" and insert -- MR TOF --, therefor.

In the specification

Column 1, line 1, delete "TIMEOF" and insert -- TIME OF --, therefor.

In the claims

Column 13, line 64, claim 6, after "the" delete "multi pass".

Column 14, line 2, claim 6, after "of" delete "and".

Column 14, line 27, claim 8, after "along the" delete "said".

Column 14, line 30, claim 8, after "ion" insert -- mirror --.

Column 14, line 35, claim 8, after "ion" insert -- mirror --.

Column 14, line 35, claim 8, after "off the" delete "mirror".

Column 16, line 2, claim 19, after "the" delete "said".

Signed and Sealed this
Third Day of May, 2016

Michelle K. Lee

Michelle K. Lee
*Director of the United States Patent and Trademark Office*

In the claims

Column 16, line 3, claim 20, delete “18” and insert -- 18, --, therefor.

Column 16, line 11, claim 20, after “the” delete “said”.

Column 16, line 18, claim 21, after “of the” delete “said”.